US005670954A

United States Patent [19]

Junker

[11] Patent Number: 5,670,954

[45] Date of Patent: Sep. 23, 1997

[54] PEDESTAL MOUNTED TRAFFIC BEACON

[76] Inventor: Wilhelm Junker, Reutlingerstrasse 14, 71422 Backnang, Germany

[21] Appl. No.: 415,271

[22] Filed: Apr. 3, 1995

[30] Foreign Application Priority Data

Feb. 24, 1995 [DE] Germany ..... 29503161 U

[51] Int. Cl.[6] ..... B60Q 7/00

[52] U.S. Cl. ..... 340/908.1; 40/608; 116/63 C; 116/63 P; 248/910; 404/10

[58] Field of Search ..... 340/908.1; 116/63 P, 116/63 C; 40/608, 612; 404/6, 9, 10; 248/910

[56] References Cited

U.S. PATENT DOCUMENTS

| | | | |
|---|---|---|---|
| 4,004,545 | 1/1977 | O'Donnell | 116/63 P |
| 4,084,914 | 4/1978 | Humphrey et al. | 404/10 |
| 4,343,567 | 8/1982 | Sarver et al. | 404/10 |
| 4,564,309 | 1/1986 | Björlund | 404/10 |
| 4,611,949 | 9/1986 | Schmanski | 404/9 |
| 5,165,818 | 11/1992 | Newhart | 404/10 |
| 5,168,827 | 12/1992 | Junker | 40/612 |
| 5,273,371 | 12/1993 | Hugron | 404/10 |
| 5,452,965 | 9/1995 | Hughes, Sr. | 404/10 |

FOREIGN PATENT DOCUMENTS 0380062 8/1990 Germany .

*Primary Examiner*—Brent A. Swarthout
*Attorney, Agent, or Firm*—Jordan and Hamburg

[57] ABSTRACT

A traffic beacon apparatus has an upper portion comprising a panel member which is attached in an upright position by coupling member to base pedestal. The coupling member is a hollow shell structure formed of an elastic material. The panel member attaches to a top of the coupling member by bolts and barbed projections which are inserted into slots in the top of the coupling member. The coupling member has a flange along a lower perimeter thereof which couples with the base pedestal. The elastic material of the coupling member is more flexible than the panel member which is formed from a relatively stiff material. Apertures are formed in opposing sides of the coupling member to define a bending portion. Sides of the coupling member disposed between the apertures flex and bend when the traffic beacon is struck by a vehicle. Due to the elastic nature of the coupling member material and the positioning of the apertures, the coupling member permits the panel member to be bent down in a collision and then return to the original upright position.

5 Claims, 4 Drawing Sheets

PEDESTAL MOUNTED TRAFFIC BEACON

BACKGROUND OF THE INVENTION

The invention relates to a traffic beacon with foot device for guiding street traffic and, more particularly, to a traffic beacon having a stiff upper portion connected to a foot portion by an elastic portion.

Traffic beacons are used particularly at construction sites to mark traffic flow where traffic must be guided differently. This occurs particularly where opposite traffic streams must be partitioned off from one another without being separated by broad traffic lane strips. The traffic beacons are either coupled individually to their own foot or they are fastened to a holder composed of individual sections, each section preferably carrying one traffic beacon. The traffic beacons are constructed so that no damage occurs if a vehicle collides with them. This is achieved by a construction allowing the traffic beacons to be bent over and run over. The traffic beacons then straighten up once again due to their inherent elasticity.

Traffic beacons coupled with a foot are known from EU 0 380 062 B1, particularly FIGS. 1 to 4. The traffic beacons consist of a hood-like, hollow body, which is open at the bottom, and are detachably connected at their lower end through a coupling device with the foot. The coupling device includes outwardly protruding flanges, disposed at the lower end of the traffic beacon, for engaging a correspondingly shaped, laterally open recess in the foot. Above the coupling device in the traffic beacon there is a nominal bending site produced by making lateral cutouts in narrow sides of the hollow body. In other words, at least approximately level connecting cross members are provided at the broad side of the hollow body. When a vehicle collides with the traffic beacon, these connecting cross members are elastically deformed. At the end of the collision or when the traffic beacons have been run over, the connecting cross members return to their original position, as a result of which the traffic beacon is once again straightened.

It has been observed that, particularly in the case of an asymmetric collision with the traffic beacon resulting twisting of the traffic beacon the hollow body can be deformed plastically with the result that the traffic beacon does not regain its original, upright position.

SUMMARY OF THE INVENTION

It is therefore an object of the invention to develop a traffic beacon which after deformation as a result of a collision with a vehicle, the traffic beacon reliably returns to its original position.

Briefly stated, the present invention provides a traffic beacon for guiding street traffic, the traffic beacon being detachably coupled at a lower end thereof to a foot, the traffic beacon consisting of an elastically deformable material having a nominal folding site region above the coupling to the foot. The traffic beacon is of a hollow shell construction with an opening at a bottom thereof, with the nominal folding site formed by lateral recesses in two narrow sides of the hollow shell. A lower portion of the traffic beacon is constructed of a soft, elastic material in the area of the nominal folding site, and an upper part of the traffic beacon is detachably attached to the lower part and formed in a panel configuration from a material stiffer than that of the elastic material of the lower part.

A feature of the invention includes the traffic beacon being divided into two parts, detachable with one another, the material used for these parts being different. The lower part namely consists of a soft, elastic synthetic material, such as rubber or of a synthetic material that acts like rubber, while the upper part is constructed from a stiffer material, preferably also a synthetic material. The deformation of the traffic beacon is thus deliberately shifted to the lower part. The upper part can also be deformed within limits. However, since it is a panel-shaped component, it cannot be destroyed or deformed plastically as easily as can a hollow body. Moreover, the upper part material is saved by the inventive construction of the traffic beacon.

BRIEF DESCRIPTION OF THE DRAWINGS

The invention is described in greater detail by means of the embodiment illustrated in the drawing, in which.

DETAILED DESCRIPTION OF THE INVENTION

Figure 2:
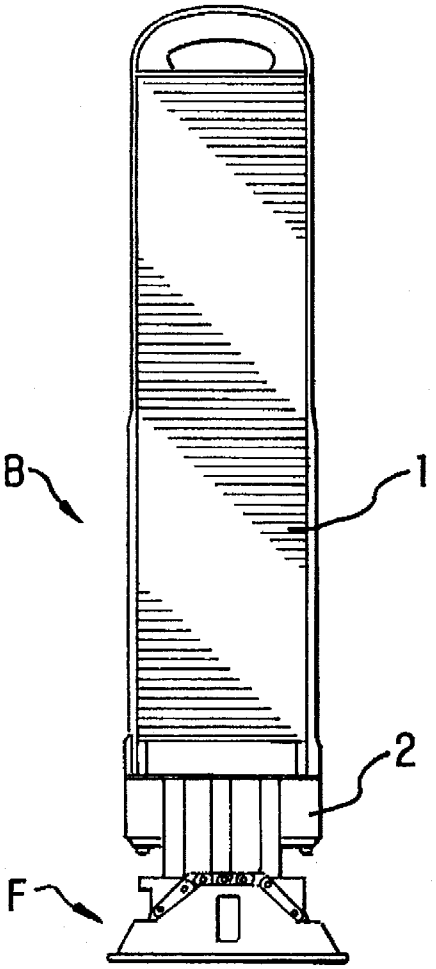
FIG. 2 PRIOR ART
FIG. 2 shows a front view of the traffic beacon with foot of FIG. 1.
Figure 1:
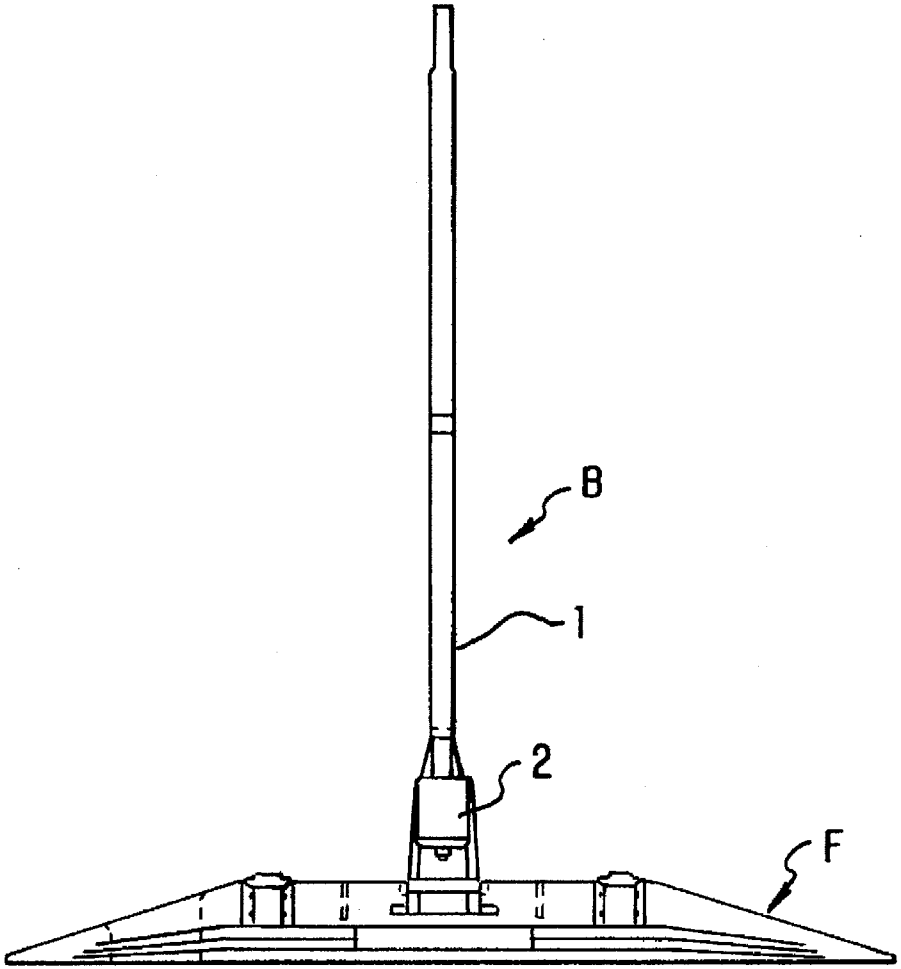
FIG. 1 PRIOR ART
FIG. 1 shows a side view of one embodiment of a traffic beacon with foot.

Referring to FIGS. 1 and 2, a traffic beacon B comprises an upper, panel-shaped part 1 and a lower part 2, which is constructed as an open hollow body. The traffic beacon B is assembled by being bolted together. The lower part 2 consists of a soft, elastic material, such as rubber or a rubber-like synthetic material. The upper part 1 consists of a stiffer implement, preferably also formed of a plastic, such as an impact resistant plastic, which does not crack at temperatures as low as –40° C.

Figure 3:
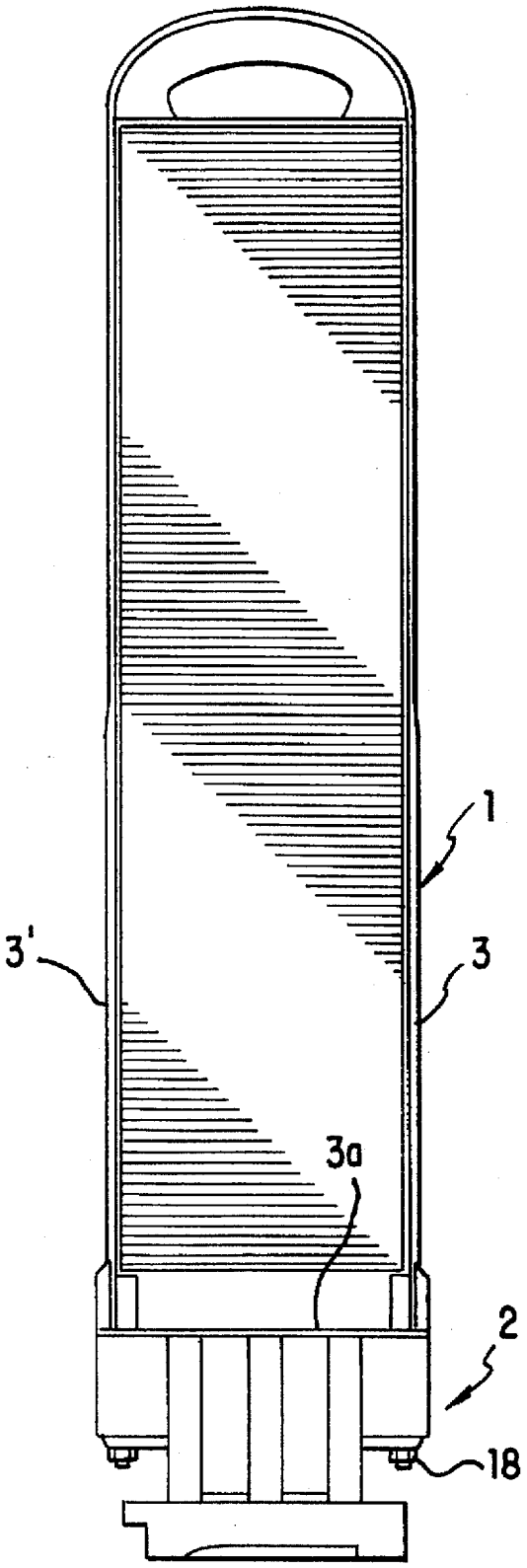
FIG. 3 PRIOR ART
FIG. 3 shows a front view of the traffic beacon in an assembled state.
Figure 4:
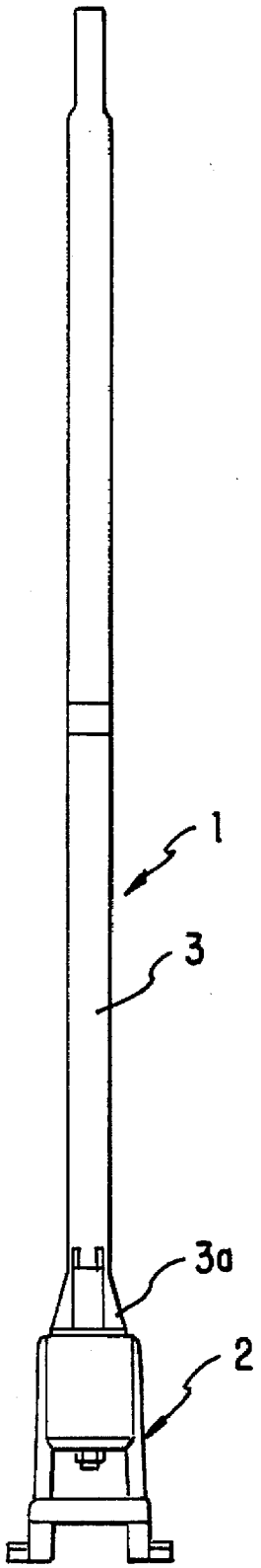
FIG. 4 PRIOR ART
FIG. 4 shows a side view of the traffic beacon in the assembled state.

Referring to FIGS. 3 and 4, the upper part 1 is provided with circumferential flanges 3, 3*a*, protruding over both sides of the panel 4. The flanges 3, 3*a* serve to stiffen the panel 4. At least on one side, the panel 4 is covered with a film, having a warning color and/or with luminous paint allowing the traffic beacon B to be visually recognized in the dark.

The lower flange 3*a* is wider than the flange 3 disposed at the sides of the panel 4. The width of the lower flange 3*a* corresponds approximately to a width of the cover 2*a* of the lower part 2 shown in FIG. 8. The lower part 2, moreover, is provided with reinforcing ribs 2*b* shown in FIGS. 7 and 9.

Figure 5:
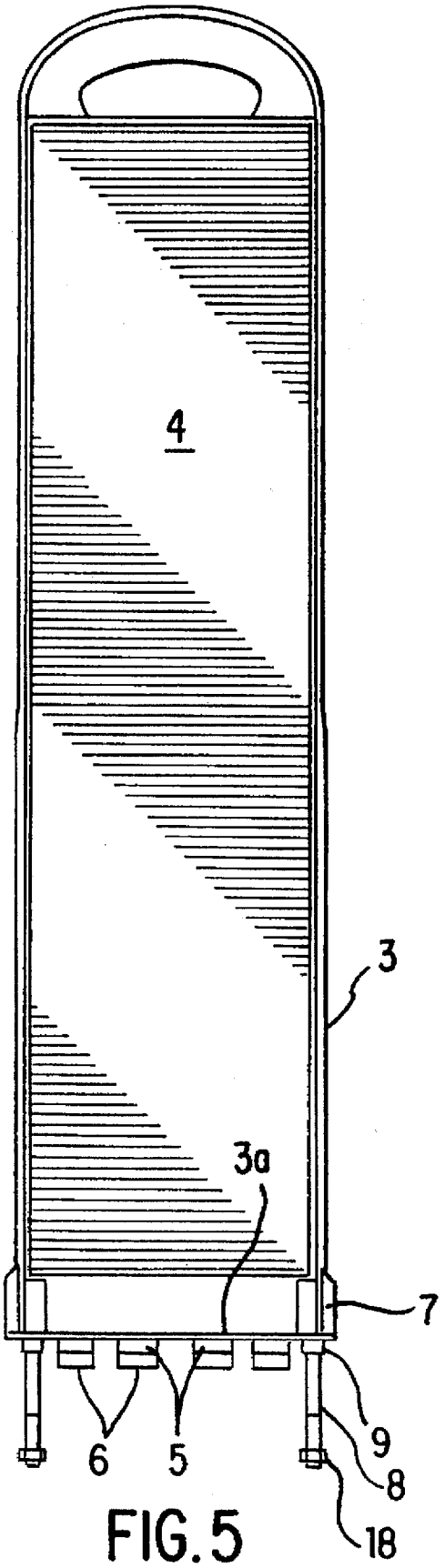
FIG. 5 shows a front view of an upper part of the traffic beacon.
Figure 6:
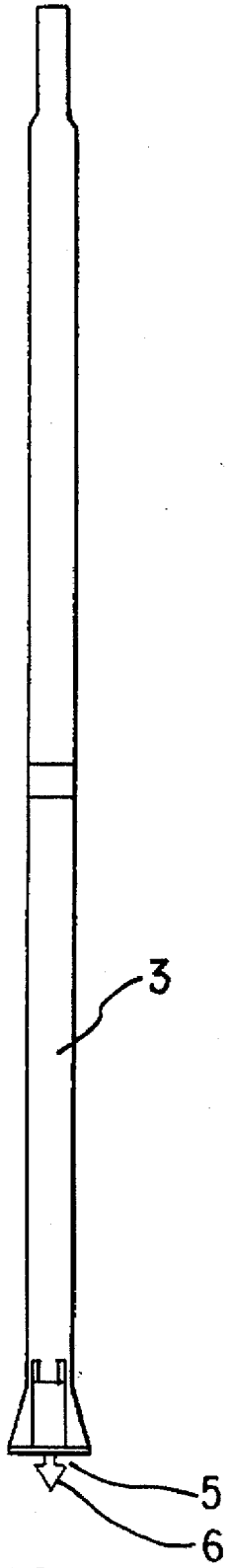
FIG. 6 shows a side view of the upper part illustrated in FIG. 5, the screw bolts having been omitted.

Referring to FIGS. 5 and 6, the lower part 2 carries cross members 5, which protrude downwards from the lower flange 3*a* and, in each case, run out into an arrow-shaped crest 6 at their free ends. The width of the crest 6 is larger than the thickness of the cross member 5 in the remaining region.

At the lower end of the upper part 1, downwards protruding screw bolts 8 are molded into laterally disposed reinforcing parts 7. A collar 9 is disposed where the screw bolts 8 leave the lower flange 3*a*.

Figure 8:
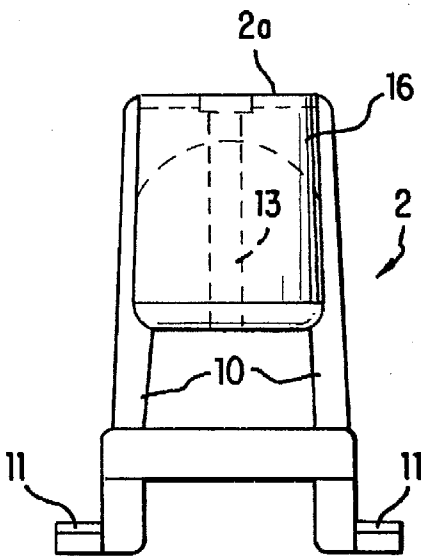
FIG. 8 shows a side view of the lower part illustrated in FIG. 4.
Figure 7:
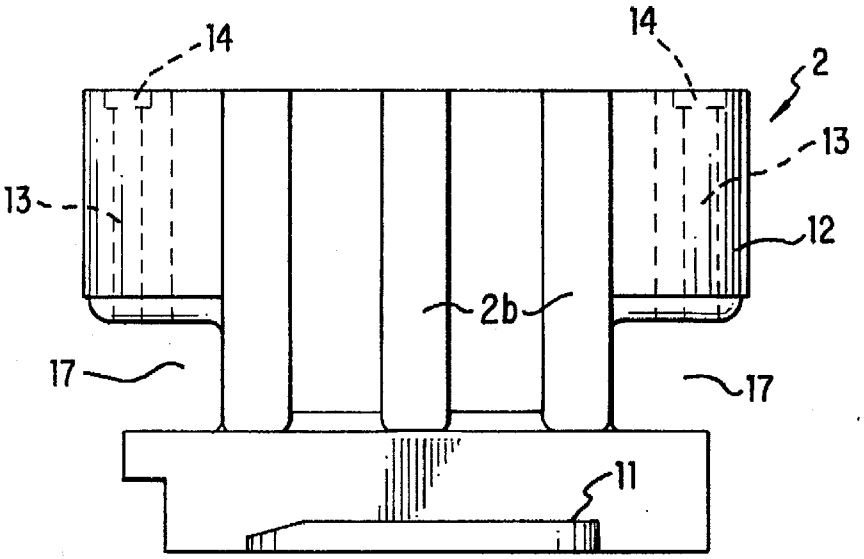
FIG. 7 shows a front view of the lower part of the traffic beacon.
Figure 9:
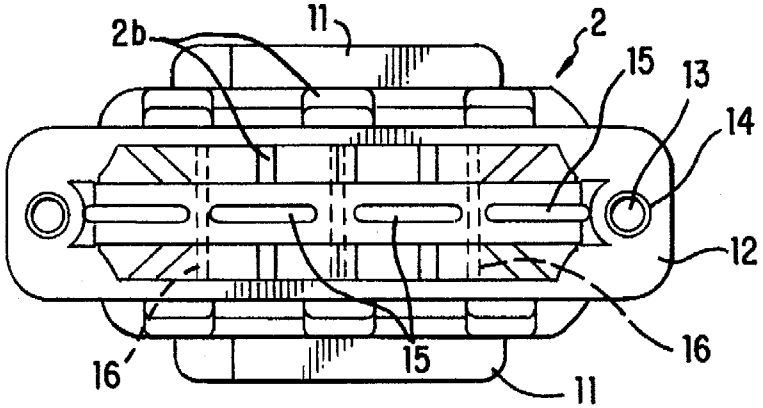
FIG. 9 shows a plan view of the lower part illustrated in FIGS. 7 and 8.

The lower part 2, shown in FIGS. 7 to 9, is constructed as a hollow body, which is open at the bottom and closed off at the top with the cover 2*a*. The lower part has cutouts 17 in narrow sides thereof to form a nominal bending site. In this region, two approximately flat connecting cross members 10 are provided as shown in FIG. 8. The recesses 17 have a height, which is somewhat less than the distance between the two connecting cross members 10.

At the lower edge of the lower part 2, there are laterally projecting flanges 11 for insertion into appropriately shaped recesses in the foot F to effect the detachable coupling between traffic beacon B and foot F. In the illustrated embodiment, every traffic beacon B has its own foot F.

Referring again to FIGS. 7 and 9, the lateral reinforcing sites 12, disposed above the cutouts 17, have boreholes 13, through which the screw bolts 8 pass. At an upper end of each borehole 8, an annular recess 14 accommodates the collar 9 shown in FIG. 5. Due to the engagement of the collar 9 with the recess 14, the upper and lower parts 1 and 2 are centered during assembly.

Referring to FIG. 5, the screw bolts 8 pass through the boreholes 13 and carry at their lower ends protruding from the reinforcing parts 12 each. The tightening of the screw bolts 8 completes the connection between the upper part 1 and the lower part 2. The screw connection can be undone at any time, so that it is possible to exchange one of the two parts readily without damage.

In addition to the screw connection, a further connection is provided by a series of slots 15, which engage the cross members 5 projecting downwards from the upper part 1. The slots 15 are provided in the cover 2*a* of the lower part 2. Connection is accomplished by pressing the crests 6 of the cross members 5 through the slots 15 producing elastic deformation particularly of the slots 15. For this purpose, it is necessary that the width of the crest 6 be larger than the width of the associated slot 15. After the crest 6 has passed through the slot 15, the crest 6 lies with a rear side at an underside of the cover 2*a* of the lower part 2. Thus, it is ensured that the upper and lower parts 1 and 2 remain connected even if the screw connection becomes loose. In the interior of the lower part 2, there are reinforcing ribs 16 between the slots 15. The reinforcing ribs 16 provide dimensional stability particularly while the crests 6 are being pressed through the slots 15. At their lower edge, the reinforcing ribs 16 are concave.

I claim:

1. A traffic beacon for guiding street traffic comprising:

a traffic beacon member formed of a first material;

a base pedestal;

a coupling member detachably coupling said traffic beacon member to said base pedestal;

said coupling member being formed from an elastically deformable material and having a folding portion;

said coupling member having a hollow body with opposing first sides and opposing second sides, said first sides being wider than said second sides, and said hollow body defining an opening at a bottom thereof;

said folding portion including opposing lateral recesses spanning each of said second sides permitting said first sides to bend at said folding portion;

said elastically deformable material of said coupling member facilitating the bending of said folding portion with said first material of said traffic beacon member being stiffer that said elastically deformable material of said coupling member;

said traffic beacon member having a panel portion with a circumferential flange;

said traffic beacon member having at least one downwards protruding tab member extending from a bottom side of said circumferential flange;

said coupling member having a top surface defining at least one slot for accepting said at least one tab member; and said tab member having a barbed expansion at a lower end thereof and said slot having a dimension in a transverse direction less than a transverse dimension of said barbed expansion.

2. The traffic beacon of claim 1 further comprising means for bolting said traffic beacon member to said coupling member.

3. The traffic beacon of claim 2 wherein said means for bolting includes screw bolts, which are molded in a lower portion of said traffic beacon member and protrude from a bottom thereof, said coupling member defining boreholes for accepting said screw bolts.

4. The traffic beacon of claim 1 further comprising:

a plurality of said at least one tab member and a corresponding plurality of said at least one slot; and at least one reinforcing rib disposed in an interior of said coupling member and between pairs of said plurality of slots.

5. The traffic beacon of claim 3 further comprising:

said traffic beacon member having a collar encircling each of said screw bolts protruding from said bottom of said traffic beacon member;

said coupling member having a corresponding recess for engaging each of said collars.

* * * * *